US012090542B2

(12) United States Patent
Ishizuka et al.

(10) Patent No.: US 12,090,542 B2
(45) Date of Patent: Sep. 17, 2024

(54) FORMING SYSTEM

(71) Applicant: SUMITOMO HEAVY INDUSTRIES, LTD., Tokyo (JP)

(72) Inventors: Masayuki Ishizuka, Ehime (JP); Kimihiro Nogiwa, Ehime (JP); Akihiro Ide, Ehime (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 557 days.

(21) Appl. No.: 17/384,379

(22) Filed: Jul. 23, 2021

(65) Prior Publication Data

US 2021/0346934 A1 Nov. 11, 2021

Related U.S. Application Data

(63) Continuation of application No. PCT/JP2020/005368, filed on Feb. 12, 2020.

(30) Foreign Application Priority Data

Mar. 27, 2019 (JP) ..... 2019-061368

(51) Int. Cl.

| | |
|---|---|
| ***B21D 26/035*** | (2011.01) |
| ***B21D 26/041*** | (2011.01) |
| ***B21D 26/045*** | (2011.01) |
| ***B21D 37/10*** | (2006.01) |
| ***B21D 37/16*** | (2006.01) |

(52) U.S. Cl.

CPC ..... *B21D 26/035* (2013.01); *B21D 26/041* (2013.01); *B21D 26/045* (2013.01); *B21D 37/10* (2013.01); *B21D 37/16* (2013.01)

(58) Field of Classification Search

CPC .. B21D 26/035; B21D 26/041; B21D 26/045; B21D 37/10; B21D 37/16

See application file for complete search history.

(56) References Cited

U.S. PATENT DOCUMENTS

| | | | | |
|---|---|---|---|---|
| 6,662,611 | B2 | 12/2003 | Janssen et al. | |
| 10,751,780 | B2 | 8/2020 | Saika et al. | |
| 2018/0015521 | A1* | 1/2018 | Saika | B21D 26/033 |

FOREIGN PATENT DOCUMENTS

| | | | |
|---|---|---|---|
| JP | S58-024701 | A | 2/1983 |
| JP | 2000-185882 | A | 7/2000 |
| JP | 2003-523286 | A | 8/2003 |
| JP | 2012-000654 | A | 1/2012 |
| JP | 2016-190263 | A | 11/2016 |
| JP | 2018-167315 | A | 11/2018 |

OTHER PUBLICATIONS

International Search Report issued in Application No. PCT/JP2020/005368, mailed Mar. 17, 2020.

* cited by examiner

*Primary Examiner* — Teresa M Ekiert
(74) *Attorney, Agent, or Firm* — Michael Best & Friedrich LLP

(57) ABSTRACT

A forming system for forming a metal pipe having a hollow shape includes a forming apparatus including a gas supply portion that supplies gas into a heated metal pipe material when forming the metal pipe, and a discharge unit that discharges the gas into the formed metal pipe, in which an exhaust port of the discharge unit is positioned in an internal space of a structure including the internal space.

13 Claims, 6 Drawing Sheets

FORMING SYSTEM

RELATED APPLICATIONS

The contents of Japanese Patent Application No. 2019-061368, and of International Patent Application No. PCT/JP2020/005368, on the basis of each of which priority benefits are claimed in an accompanying application data sheet, are in their entirety incorporated herein by reference.

BACKGROUND

Technical Field

A certain embodiment of the present invention relates to a forming system.

Description of Related Art

In the related art, a forming apparatus for forming a metal pipe including a pipe portion and a flange portion by supplying a gas into a heated metal pipe material and expanding the material is known. For example, the following the related art discloses a forming apparatus including: upper and lower dies to be paired with each other; a gas supply portion that supplies a high-pressure gas into a metal pipe material held between the upper and lower dies; a heating mechanism that heats the metal pipe material; and a cavity portion formed by combining the upper and lower dies.

SUMMARY

According to an embodiment of the present invention, there is provided a forming system for forming a metal pipe having a hollow shape, the system including: a forming apparatus including a gas supply portion that supplies gas into a heated metal pipe material when forming the metal pipe, and a discharge unit that discharges the gas into the formed metal pipe, in which an exhaust port of the discharge unit is positioned in an internal space of a structure having the internal space.

DETAILED DESCRIPTION

Figure 1:
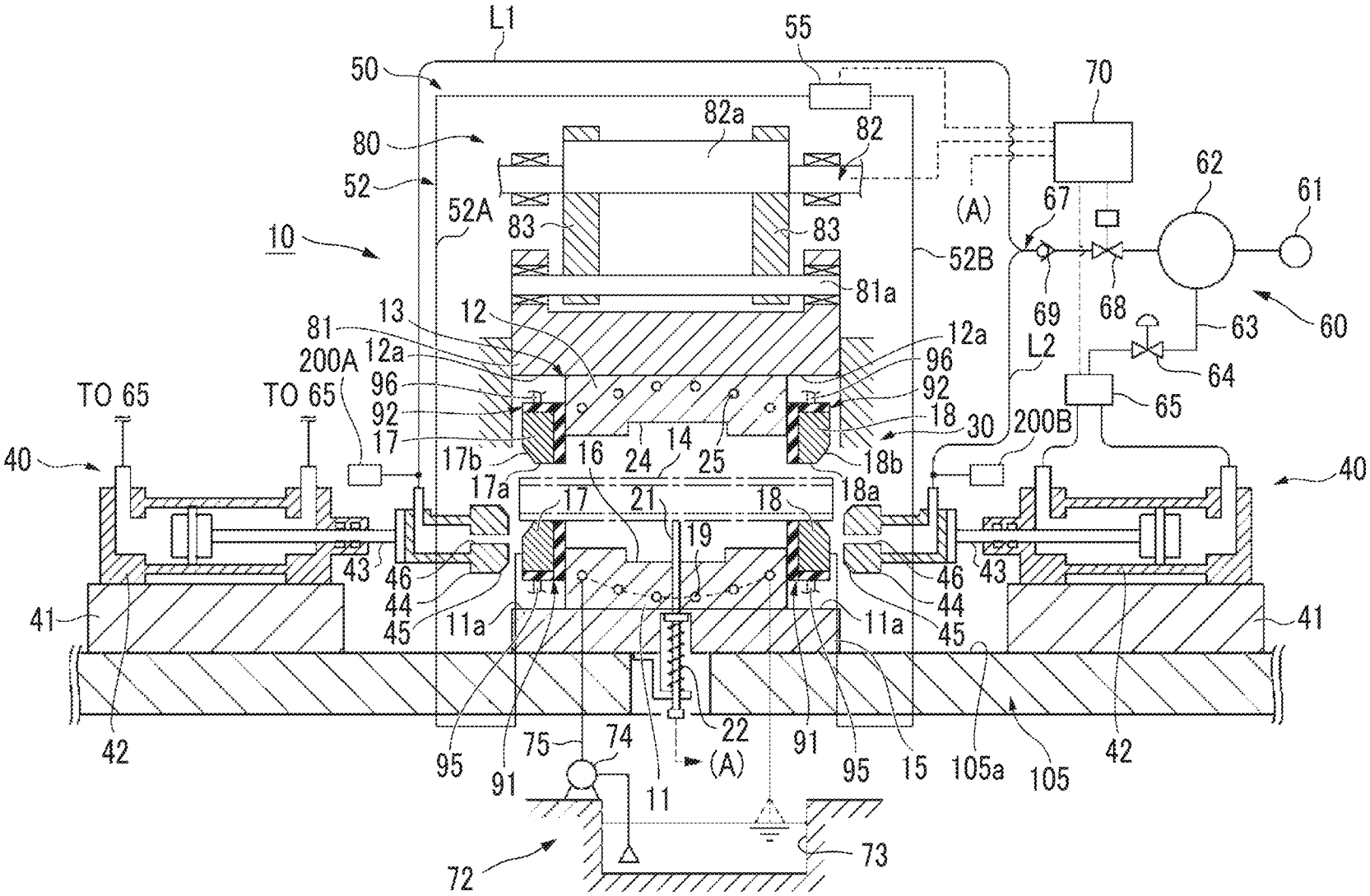
FIG. 1 is a schematic configuration view of a forming apparatus of a forming system according to the present embodiment.

In order to improve the productivity of the metal pipe formed by the forming apparatus as shown in the related art, it is necessary to rapidly discharge the high-pressure gas from the metal pipe. In this case, the discharge noise of the gas becomes loud, and thus, the discharge noise can be noise to the worker of the forming apparatus or the like. Therefore, countermeasures against the above-described discharge noise are required.

It is desirable to provide a forming system capable of taking countermeasures against discharge noise.

According to the forming system, the exhaust port of the discharge unit is positioned in the internal space of the structure having the internal space. Therefore, the discharge noise generated when the high-pressure gas is exhausted from the exhaust port is generated in the structure. In this case, the structure functions as a silencer for the discharge noise. Therefore, the discharge noise is less likely to be noisy to a worker and the like who works around the forming apparatus. Therefore, by using the above-described forming system, it is possible to take countermeasures against the discharge noise.

The forming system includes: a floor surface on which the forming apparatus is placed; and an underground pit provided at a lower portion of the floor surface. The discharge unit may include an exhaust pipe positioned in the underground pit as the structure and provided with the exhaust port.

According to this forming system, the exhaust pipe included in the discharge unit and provided with the exhaust port is positioned in the underground pit provided at the lower portion of the floor surface. Accordingly, the discharge noise generated when the high-pressure gas is exhausted from the exhaust port is generated in the underground pit. Therefore, the discharge noise is less likely to be noisy to the worker and the like who is on the floor surface and works around the forming apparatus. Therefore, by using the above-described forming system, it is possible to take countermeasures against the discharge noise. The structure that functions as a silencer is provided in the underground pit, which contributes to reducing the space of the entire forming apparatus.

The forming apparatus may further include an electrode for heating the metal pipe material and a power supply line connected to the electrode, the power supply line may have a conductor accommodated in the underground pit, and in the underground pit, the exhaust port may face the conductor. In this case, the conductor heated by energizing the electrodes can be cooled by the gas exhausted from the exhaust port.

Hereinafter, preferred embodiments of a forming system according to an aspect of the present disclosure will be described with reference to the drawings. In addition, in each drawing, the same reference numerals are assigned to the same portions or the corresponding portions, and repeated descriptions thereof are omitted.

Configuration of Forming Apparatus

FIG. 1 is a schematic configuration view of a forming apparatus of a forming system according to the present embodiment. As shown in FIG. 1, a forming apparatus 10 for forming a metal pipe includes a forming die 13 including an upper die 12 and a lower die 11, a drive mechanism 80 which moves at least one of the upper die 12 and the lower die 11, a pipe holding mechanism 30 which holds a metal pipe material 14 disposed between the upper die 12 and the lower die 11, a heating mechanism 50 which energizes the metal pipe material 14 held by the pipe holding mechanism 30 to heat the metal pipe material 14, a gas supply portion 60 which supplies a high-pressure gas (gas) into the metal pipe material 14 which is held between the upper die 12 and the lower die 11 and is heated, a pair of gas supply mechanisms 40 and 40 for supplying the gas from the gas supply portion 60 into the metal pipe material 14 held by the pipe holding mechanism 30, and a water circulation mechanism 72 which forcibly water-cools the forming die 13, and a controller 70 which controls driving of the drive mechanism 80, driving of the pipe holding mechanism 30, driving of the heating mechanism 50, and gas supply of the gas supply portion 60. In the following, the metal pipe material 14 is a hollow structure body before forming, and the metal pipe is a hollow structure after forming. Therefore, each of the metal pipe materials 14 and the metal pipe has a hollow shape.

The lower die 11, which is one part of the forming die 13, is fixed to a base stage 15. The lower die 11 is formed of a large steel block and includes a rectangular cavity (recessed portion) 16 on the upper surface of the lower die 11, for example. A cooling water passage 19 is formed in the lower die 11. Further, the lower die 11 includes a thermocouple 21 inserted from below substantially at the center. The thermocouple 21 is supported to be movable upward or downward by a spring 22.

Furthermore, the spaces 11*a* are provided in the vicinity of left and right ends (left and right ends in FIG. 1) of the lower die 11, and in the spaces 11*a*, the electrodes 17 and 18 (lower electrodes or like), which are movable portions of the pipe holding mechanism 30 and will be described later, are disposed to be capable of advancing and retreating upward and downward. In addition, the metal pipe material 14 is placed on the lower electrodes 17 and 18, and accordingly, the lower electrodes 17 and 18 come into contact with the metal pipe material 14 disposed between the upper die 12 and the lower die 11. Accordingly, the lower electrodes 17 and 18 are electrically connected to the metal pipe material 14.

Insulating materials 91 for preventing energization are respectively provided between the lower die 11 and the lower electrode 17 and under the lower electrode 17, and between the lower die 11 and the lower electrode 18 and under the lower electrode 18. Each of the insulating materials 91 is fixed to an advancing and retreating rod 95, which is a movable portion of an actuator (not shown) that configures the pipe holding mechanism 30. The actuator is for moving the lower electrodes 17 and 18 or the like upward or downward and a fixation portion of the actuator is held on the base stage 15 side together with the lower die 11.

The upper die 12, which is the other part of the forming die 13, is fixed to a slide 81 (which will be described later) that configures the drive mechanism 80. The upper die 12 is formed of a large steel block, a cooling water passage 25 is formed in the upper die 12, and the upper die 12 includes a rectangular cavity (recessed portion) 24 on the lower surface of the upper die 12, for example. The cavity 24 is provided at a position facing the cavity 16 of the lower die 11.

Similar to the lower die 11, spaces 12*a* are provided in the vicinity of left and right ends (left and right ends in FIG. 1) of the upper die 12, and electrodes 17 and 18 (upper electrodes) or the like, which are movable portions of the pipe holding mechanism 30 and will be described later, are disposed in the spaces 12*a* to be capable of advancing and retreating upward and downward. In addition, in a state where the metal pipe material 14 is placed on the lower electrodes 17 and 18, the upper electrodes 17 and 18 move downward, and accordingly, the upper electrodes 17 and 18 come into contact with the metal pipe material 14 disposed between the upper die 12 and the lower die 11. Accordingly, the upper electrodes 17 and 18 are electrically connected to the metal pipe material 14.

Insulating materials 92 for preventing energization are respectively provided between the upper die 12 and the upper electrode 17 and above the upper electrode 17, and between the upper die 12 and the upper electrode 18 and above the upper electrode 18. Each of the insulating materials 92 is fixed to an advancing and retreating rod 96, which is a movable portion of an actuator (not shown) that configures the pipe holding mechanism 30. The actuator is for moving the upper electrodes 17 and 18 or the like upward or downward and a fixation portion of the actuator is held on the slide 81 side of the drive mechanism 80 together with the upper die 12.

Figure 2A:
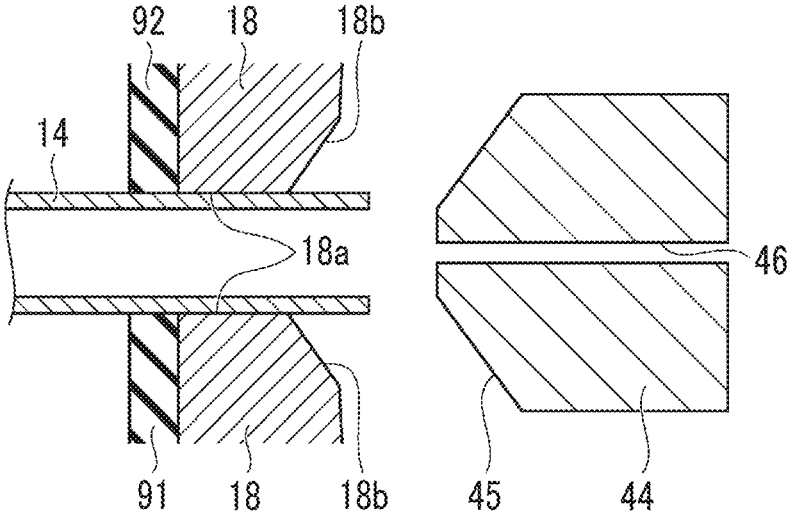
FIG. 2A is a view showing a state where an electrode holds a metal pipe material.
Figure 2B:
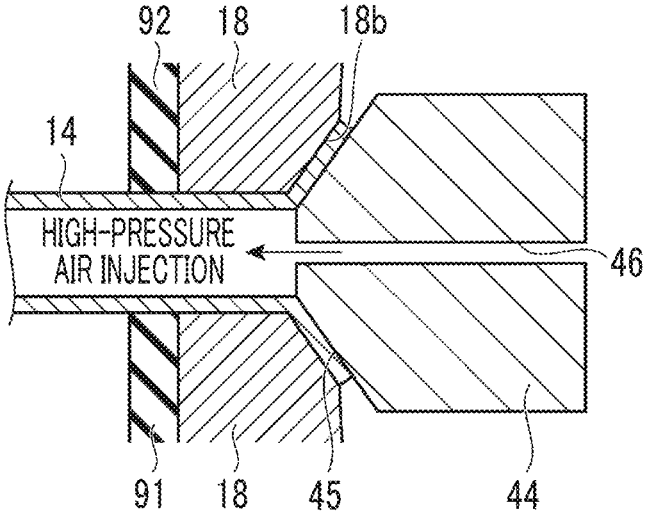
FIG. 2B is a view showing a state where a gas supply nozzle is in contact with the electrode.
Figure 2C:
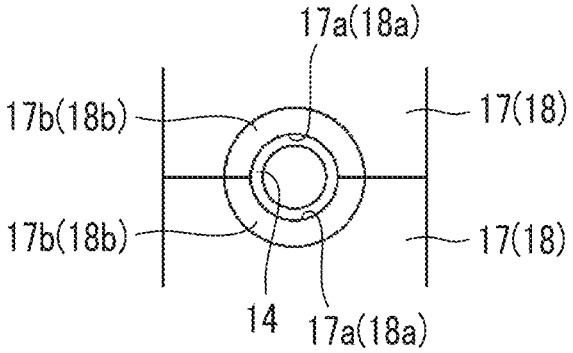
FIG. 2C is a front view of the electrode.

At the right part of the pipe holding mechanism 30, a semi-arc-shaped concave groove 18*a* corresponding to an outer peripheral surface of the metal pipe material 14 is formed on each of surfaces of the electrodes 18 and 18 that face each other (refer to FIG. 2C). At the portion of the concave groove 18*a*, the metal pipe material 14 can be placed to be fitted thereinto. At the right part of the pipe holding mechanism 30, on the exposed surfaces of the insulating materials 91 and 92 that face each other, similar to the concave groove 18*a*, a semi-arc-shaped concave groove corresponding to the outer peripheral surface of the metal pipe material 14 is formed. In addition, on the front surface (surface facing the outside of the die) of the electrode 18, the tapered concave surface 18*b* which is recessed with peripheries thereof inclined to forma tapered shape toward the concave groove 18*a*, is formed. Accordingly, when the metal pipe material 14 is sandwiched in the up-down direction at the right part of the pipe holding mechanism 30, the electrodes 18 can exactly surround the outer periphery of a right end portion of the metal pipe material 14 so as to come into close contact with the entire periphery.

At the left part of the pipe holding mechanism 30, a semi-arc-shaped concave groove 17*a* corresponding to an outer peripheral surface of the metal pipe material 14 is formed on each of surfaces of the electrodes 17 and 17 that face each other (refer to FIG. 2C). At the portion of the concave groove 17*a*, the metal pipe material 14 can be placed to be fitted thereinto. At the left part of the pipe holding mechanism 30, on the exposed surfaces of the insulating materials 91 and 92 that face each other, similar to the concave groove 18*a*, a semi-arc-shaped concave groove corresponding to the outer peripheral surface of the metal pipe material 14 is formed. In addition, on the front surface (surface facing the outside of the die) of the electrode 17, the tapered concave surface 17*b* which is recessed with peripheries thereof inclined to forma tapered shape toward the concave groove 17*a*, is formed. Accordingly, when the metal pipe material 14 is sandwiched in the up-down direction at the left part of the pipe holding mechanism 30, the electrodes 17 can exactly surround the outer periphery of a left end portion of the metal pipe material 14 so as to come into close contact with the entire periphery.

Returning to FIG. 1, the drive mechanism 80 includes the slide 81 which moves the upper die 12 such that the upper die 12 and the lower die 11 are combined to each other, a shaft 82 which generates a driving force for moving the slide 81, and a connecting rod 83 for transmitting the driving force generated by the shaft 82 to the slide 81. The shaft 82 extends in the left-right direction above the slide 81, is supported to be rotatable, and includes an eccentric crank 82*a* which protrudes from left and right ends at a position separated from the axial center of the shaft 82 and extends in the left-right direction. The eccentric crank 82*a* and a rotary shaft 81*a* which is provided above the slide 81 and extends in the left-right direction are connected to each other by the connecting rod 83. In a case of the drive mechanism 80, the upward and downward movement of the slide 81 can be controlled by the controller 70 that controls rotation of the shaft 82 such that the height of the eccentric crank 82*a* in the up-down direction is changed and the positional change of the eccentric crank 82*a* is transmitted to the slide 81 through the connecting rod 83. Here, oscillation (rotary motion) of the connecting rod 83 generated when the positional change of the eccentric crank 82*a* is transmitted to the slide 81 is absorbed by the rotary shaft 81*a*. Note that, the shaft 82 is rotated or stopped in accordance with the driving of a motor or the like controlled by the controller 70, for example.

The heating mechanism 50 includes a power supply portion 55 and a power supply line 52 which electrically connects the power supply portion 55 and the electrodes 17 and 18 to each other. The power supply portion 55 includes a DC power source and a switch and can energize the metal pipe material 14 through the power supply line 52 and the electrodes 17 and 18 in a state where the electrodes 17 and 18 are electrically connected to the metal pipe material 14. The power supply line 52 has a power supply line 52A connected to the lower electrode 17 and a power supply line 52B connected to the lower electrode 18.

In the heating mechanism 50, a DC current output from the power supply portion 55 is transmitted through the power supply line 52A and input to the electrode 17. Then, the DC current passes through the metal pipe material 14 and is input to the electrode 18. Then, the DC current is transmitted through the power supply line 52B and input to the power supply portion 55.

Returning to FIG. 1, each of the pair of gas supply mechanisms 40 includes a cylinder unit 42, a cylinder rod 43 that advances and retreats in accordance with the operation of the cylinder unit 42, and a seal member 44 connected to the tip of the cylinder rod 43 on the pipe holding mechanism 30 side. The cylinder unit 42 is placed and fixed on a block 41. At the tip of the seal member 44, the tapered surface 45 is formed to be tapered, and the tip is configured to have a shape in accordance with the tapered concave surfaces 17*b* and 18*b* of the electrodes 17 and 18 (refer to FIGS. 2A to 2C). The seal member 44 is provided with a gas passage 46 which extends toward the tip from the cylinder unit 42 side and in which a high-pressure gas supplied from the gas supply portion 60 flows.

The gas supply portion 60 includes a gas source 61, an accumulator 62 in which the gas supplied by the gas source 61 is collected, a first tube 63 which extends from the accumulator 62 to the cylinder unit 42 of the gas supply mechanism 40, a pressure control valve 64 and a switching valve 65 which are provided in the first tube 63, a second tube 67 which extends from the accumulator 62 to the gas passage 46 formed in the seal member 44, and a pressure control valve 68 and a check valve 69 which are provided in the second tube 67. The pressure control valve 64 plays a role of supplying a gas, which has an operation pressure applied to a pressing force against the metal pipe material 14 of the seal member 44, to the cylinder unit 42. The check valve 69 plays a role of preventing the high-pressure gas from backflowing in the second tube 67. The pressure control valve 68 provided in the second tube 67 plays a role of supplying a gas having an operation pressure for expanding the metal pipe material 14 to the gas passage 46 of the seal member 44 by being controlled by the controller 70. The second tube 67 is branched from the check valve 69 into two, and has a gas supply line L1 that extends to one of the gas supply mechanisms 40 and a gas supply line L2 that extends to the other one of the gas supply mechanisms 40.

The forming apparatus 10 includes exhaust mechanisms (discharge units) 200A and 200B for exhausting the gas in the formed metal pipe. The exhaust mechanism 200A is connected to the gas supply line L1, and the exhaust mechanism 200B is connected to the gas supply line L2. Therefore, the exhaust mechanism 200A exhausts the gas in the metal pipe through the gas supply line L1 and the gas passage 46 of one of the gas supply mechanisms 40. The exhaust mechanism 200B exhausts the gas in the metal pipe through the gas supply line L2 and the gas passage 46 of the other one of the gas supply mechanisms 40. Each of the exhaust mechanisms 200A and 200B has, for example, an exhaust pipe (details thereof will be described later) that branches from each supply line and is provided with an exhaust port. Each of the exhaust mechanisms 200A and 200B has a pressure control valve, a safety valve, and the like of which opening and closing are controlled by the controller 70. The position where the pressure control valve, the safety valve, and the like are provided is not particularly limited.

The controller 70 can control the pressure control valve 68 of the gas supply portion 60 such that a gas having a desired operation pressure is supplied into the metal pipe material 14. With the information transmitted from (A) shown in FIG. 1, the controller 70 acquires temperature information from the thermocouple 21 and controls the drive mechanism 80 and the power supply portion 55.

The water circulation mechanism 72 includes a water tank 73 which collects water, a water pump 74 which pumps up the water collected in the water tank 73 and pressurizes and sends the water to the cooling water passage 19 of the lower die 11 and the cooling water passage 25 of the upper die 12, and a pipe 75. Although omitted, a cooling tower for lowering the water temperature and a filter for purifying the water may be provided in the pipe 75.

Metal Pipe Forming Method Using Forming Apparatus

Next, a metal pipe forming method using the forming apparatus 10 will be described. First, the quenchable steel type cylindrical metal pipe material 14 is prepared. For example, the metal pipe material 14 is placed (loaded) on the electrodes 17 and 18 provided on the lower die 11 side by using a robot armor the like. Since the concave grooves 17*a* and 18*a* are formed on the electrodes 17 and 18, the metal pipe material 14 is positioned by the concave grooves 17*a* and 18*a*.

Next, the controller 70 controls the drive mechanism 80 and the pipe holding mechanism 30 such that the metal pipe material 14 is held by the pipe holding mechanism 30. Specifically, the drive mechanism 80 is driven such that the upper die 12 held on the slide 81 side and the upper electrodes 17 and 18 are moved to the lower die 11 side, the actuator that can make the upper electrodes 17 and 18 and the lower electrodes 17 and 18 included in the pipe holding mechanism 30 advance and retreat is operated, and accordingly, the vicinity of the both end portions of the metal pipe material 14 is sandwiched by the pipe holding mechanism 30 from above and below. The sandwiching is performed in an aspect in which the concave grooves 17*a* and 18*a* formed on the electrodes 17 and 18 and the concave grooves formed on the insulating materials 91 and 92 are provided such that the electrodes 17 and 18 come into close contact with the vicinity of the both end portions of the metal pipe material 14 over the entire periphery.

At this time, as shown in FIG. 2A, the end portion of the metal pipe material 14 on the electrode 18 side protrudes toward the seal member 44 beyond a boundary between the concave grooves 18*a* and the tapered concave surfaces 18*b* of the electrodes 18 in the extending direction of the metal pipe material 14. Similarly, the end portion of the metal pipe material 14 on the electrode 17 side protrudes toward the seal member 44 beyond a boundary between the concave grooves 17*a* and the tapered concave surfaces 17*b* of the electrodes 17 in the extending direction of the metal pipe material 14. In addition, lower surfaces of the upper electrodes 17 and 18 and upper surfaces of the lower electrodes 17 and 18 are in contact with each other. However, the present disclosure is not limited to a configuration in which the electrodes 17 and 18 come into close contact with the entire peripheries of the both end portions of the metal pipe material 14, and the electrodes 17 and 18 may be in contact with a part of the metal pipe material 14 in the peripheral direction.

Next, the controller 70 controls the heating mechanism 50 so as to heat the metal pipe material 14. Specifically, the controller 70 controls the power supply portion 55 of the heating mechanism 50 such that electric power is supplied. As a result, the electric power transmitted to the lower electrodes 17 and 18 through the power supply line 52 is supplied to the upper electrodes 17 and 18 that sandwiches the metal pipe material 14 and the metal pipe material 14, and due to a resistance of the metal pipe material 14, the metal pipe material 14 itself generates heat by Joule heat. In other words, the metal pipe material 14 enters an energized and heated state.

Next, the controller 70 controls the drive mechanism 80 such that the forming die 13 is closed with respect to the heated metal pipe material 14. Accordingly, the cavity 16 of the lower die 11 and the cavity 24 of the upper die 12 are combined with each other such that the metal pipe material 14 is disposed in a cavity portion between the lower die 11 and the upper die 12 and is sealed.

Thereafter, by operating the cylinder unit 42 of the gas supply mechanism 40, the seal member 44 advances such that both ends of the metal pipe material 14 are sealed. At this time, as shown in FIG. 2B, the seal member 44 is pressed against the end portion of the metal pipe material 14 on the electrode 18 side, and accordingly, a portion that protrudes toward the seal member 44 beyond the boundary between the concave grooves 18*a* and the tapered concave surfaces 18*b* of the electrodes 18 is deformed into a funnel shape to follow the tapered concave surfaces 18*b*. Similarly, the seal member 44 is pressed against the end portion of the metal pipe material 14 on the electrode 17 side, and accordingly, a portion that protrudes toward the seal member 44 beyond the boundary between the concave grooves 17*a* and the tapered concave surfaces 17*b* of the electrodes 17 is deformed into a funnel shape to follow the tapered concave surfaces 17*b*. After the sealing is completed, a high-pressure gas is blown into the metal pipe material 14 and the heated and softened metal pipe material 14 is formed so as to follow the shape of the cavity portion.

The metal pipe material 14 is heated to a high temperature (approximately 950° C.) and softened, and accordingly, the gas supplied into the metal pipe material 14 thermally expands. Therefore, for example, compressed air may be used as the gas to be supplied such that expansion is easily performed by compressed air obtained by thermally expanding the metal pipe material 14 of 950° C.

An outer peripheral surface of the blow-formed and expanded metal pipe material 14 comes into contact with the cavity 16 of the lower die 11 so as to be rapidly cooled and comes into contact with the cavity 24 of the upper die 12 so as to be rapidly cooled (since the upper die 12 and the lower die 11 have a large heat capacity and are controlled to a low temperature, when the metal pipe material 14 comes into contact with the upper die 12 and the lower die 11, the heat of the pipe surface is taken to the die side at once) at the same time, and thus, quenching is performed. The above-described cooling method is referred to as die contact cooling or die cooling. Immediately after being rapidly cooled, austenite transforms into martensite (hereinafter, transformation from austenite to martensite is referred to as martensitic transformation). The cooling speed is set to be low in a second half of the cooling, and thus, martensite transforms into another structure (such as troostite, sorbite, or the like) due to recuperation. Therefore, it is not necessary to separately perform tempering treatment. In the present embodiment, the cooling may be performed by supplying a cooling medium into, for example, the cavity 24, instead of or in addition to the die cooling. For example, cooling may be performed by bringing the metal pipe material 14 into contact with the dies (the upper die 12 and the lower die 11) until a temperature at which the martensitic transformation starts is reached, and the dies may be opened thereafter with a cooling medium (cooling gas) blown onto the metal pipe material 14 such that martensitic transformation occurs.

As described above, a metal pipe having an approximately rectangular main body is obtained by performing cooling after the blow forming with respect to the metal pipe material 14 and by performing die opening.

Configuration of Forming System

Figure 3:
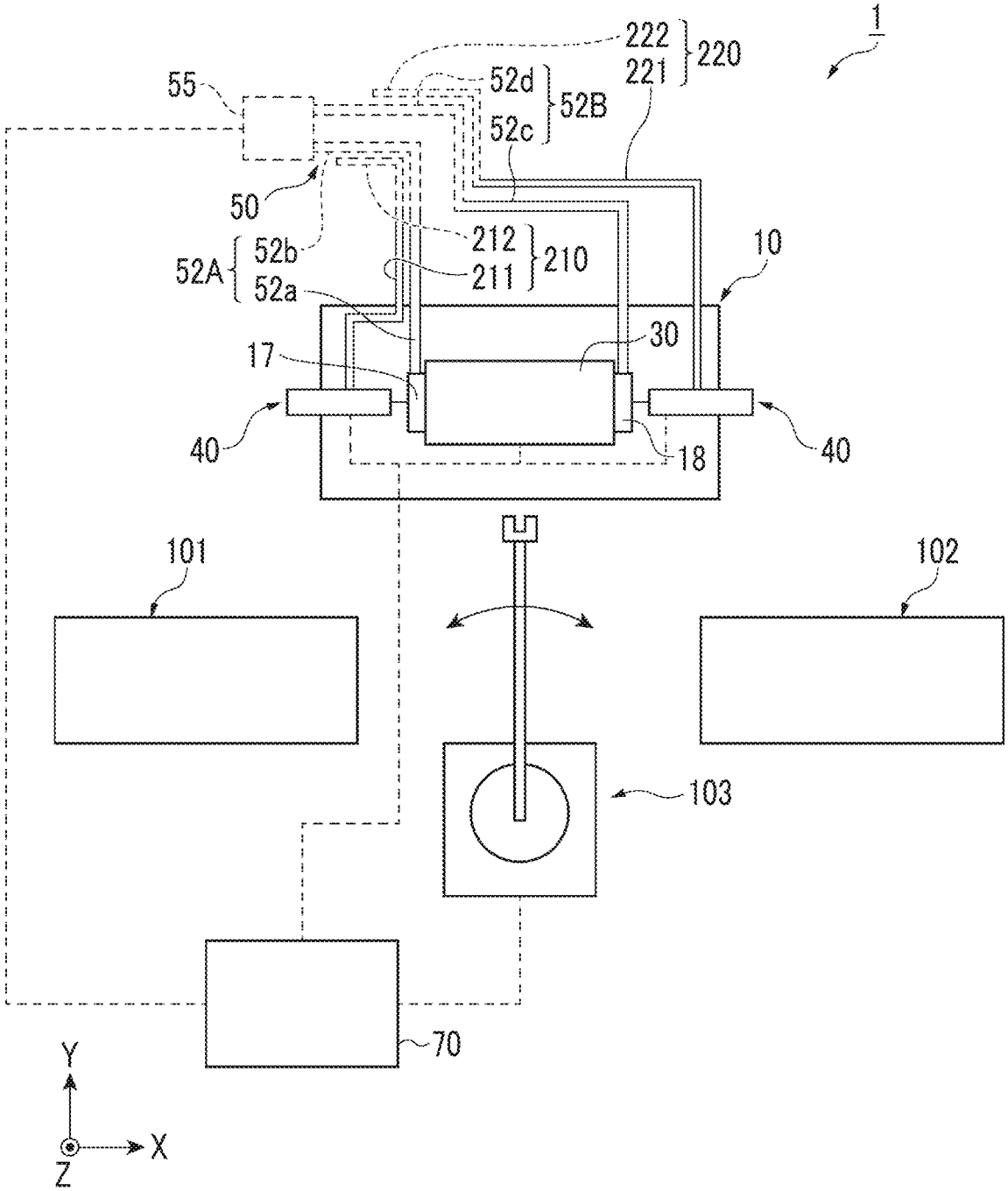
FIG. 3 is a schematic plan view of the forming system.
Figure 4:
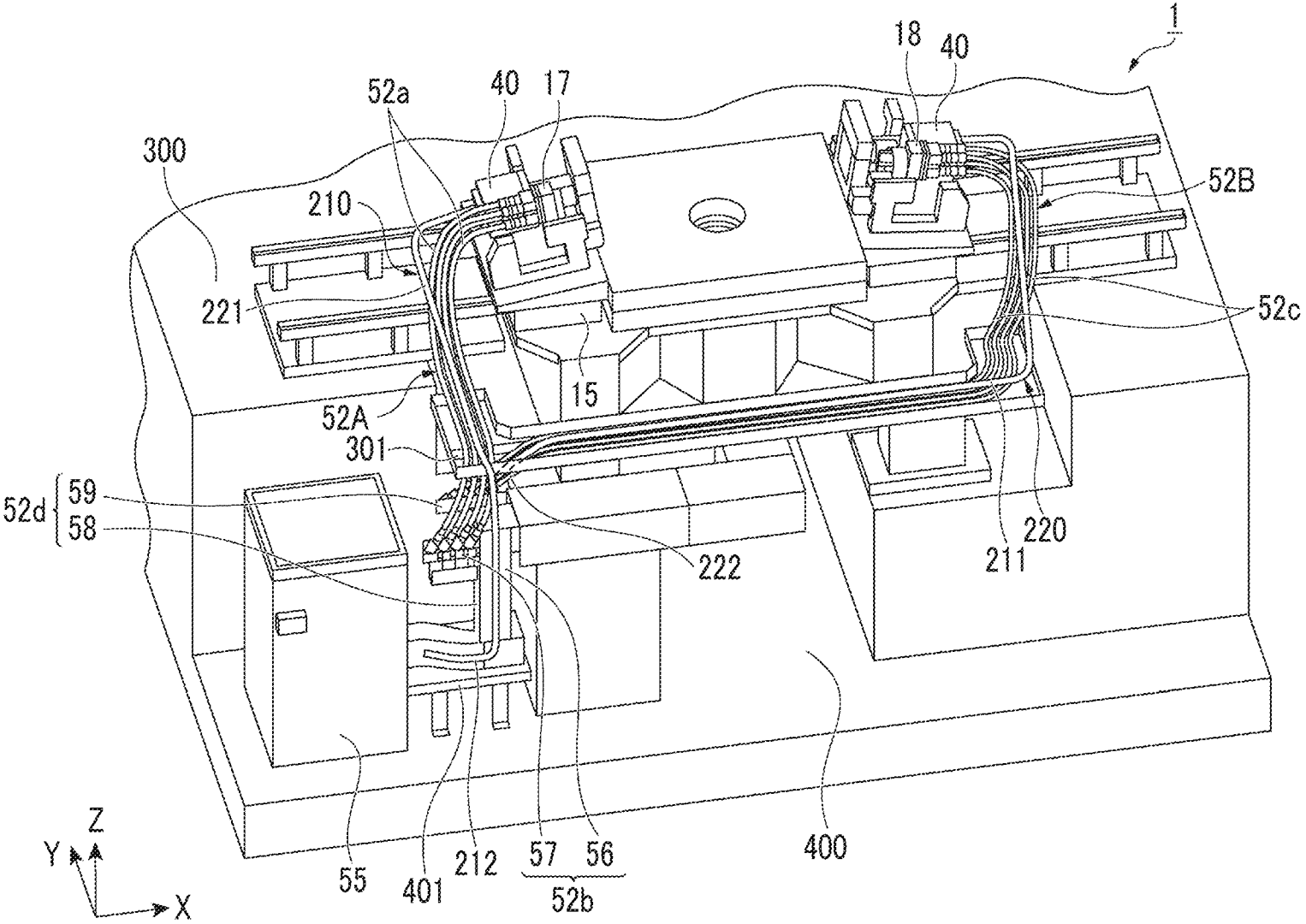
FIG. 4 is a schematic perspective view of a main part of the forming system.

Next, with reference to FIGS. 3 and 4, a forming system 1 according to the present embodiment will be described. FIG. 3 is a schematic plan view of the forming system 1. FIG. 4 is a schematic perspective view of a main part of the forming system 1.

As shown in FIG. 3, the forming system 1 includes the forming apparatus 10, a first placing unit 101 on which the metal pipe material 14 is placed, a second placing unit 102 on which the formed metal pipe is placed, a transport mechanism 103 for transporting the metal pipe material 14 or the metal pipe, and the controller 70. As shown in FIG. 4, the forming system 1 further includes a floor surface 300 on which a part of the forming apparatus 10 is placed, and an underground pit 400 (structure) provided below the floor surface 300. In FIG. 4, for the sake of description, apart of the forming apparatus 10 and a part of the floor surface 300 are omitted. Hereinafter, a direction in which the electrode 17 and the electrode 18 face each other in the horizontal direction is referred to as "X-axis direction", a direction perpendicular to the X-axis direction in the horizontal direction is referred to as "Y-axis direction", and the up-down direction is referred to as "Z-axis direction".

The first placing unit 101 is positioned on one side of the center of the forming apparatus 10 in the direction X, and is positioned on one side of the center of the forming apparatus 10 in the direction Y. The second placing unit 102 is positioned on the other side of the center of the forming apparatus 10 in the direction X, and is positioned on one side of the center of the forming apparatus 10 in the direction Y. The transport mechanism 103 is a mechanism for installing the metal pipe material 14 on the forming apparatus 10 and taking out the formed metal pipe, and has a main body 103*a* and a robot arm 103*b*. The transport mechanism 103 is positioned between the first placing unit 101 and the second placing unit 102 in the direction X. In the direction Y, the main body 103*a* is further separated from the forming apparatus 10 than the first placing unit 101 and the second placing unit 102, but is not limited thereto.

The floor surface 300 is a placement surface on which the base stage 15 of the forming apparatus 10, the forming die 13, the gas supply mechanism 40, the drive mechanism 80, and the like are placed. The floor surface 300 may be, for example, the floor itself of a factory or the like, or the surface of a table provided on the floor. The floor surface 300 is provided with an opening 301 through which the power supply line 52A and 52B are inserted. The underground pit 400 is an accommodation space for accommodating a part of the forming apparatus 10. At least a part of the underground pit 400 overlaps a portion of the forming apparatus 10 positioned on the floor surface 300. The space on the floor surface 300 and the underground pit 400 are connected to each other through the opening 301. Although not shown, the entrance and exit of the underground pit 400 is provided at a location that does not overlap with the forming apparatus 10 in the direction Z. The opening 301 may be closed by a lid or the like.

The power supply portion 55 in the heating mechanism 50 is a device that supplies electric power to the electrodes 17 and 18 through the power supply lines 52A and 52B. The power supply portion 55 is positioned on the other side of the center of the forming apparatus 10 in the direction Y, and is accommodated in the underground pit 400. The power supply portion 55 is disposed at a position that does not overlap the base stage 15 in the direction Z.

The power supply line 52A has a plurality of electric wires 52*a* and a busbar 52*b* (conductor). The plurality of electric wires 52*a* are a wire for connecting the electrode 17 and the busbar 52*b*. Therefore, one terminal of the electric wire 52*a* is connected to the electrode 17, and the other terminal of the electric wire 52*a* is connected to the busbar 52*b*. A large part of the electric wire 52*a* is routed on the floor surface 300. A part of the electric wire 52*a* including the other terminal is disposed in the underground pit 400 through the opening 301 provided in the floor surface 300. The busbar 52*b* is a conductive structure that connects the power supply portion 55 and the electric wire 52*a*, and is accommodated in the underground pit 400. The busbar 52*b* is a conductor made of a metal such as copper or an alloy, and is a location where the heat can be generated most in the power supply line 52A. The busbar 52*b* is placed on a pedestal 401 fixed in, for example, the underground pit 400. The busbar 52*b* is disposed at a position that does not overlap the base stage 15 in the direction Z. The busbar 52*b* has a substantially L-shaped main body 56 and a terminal unit 57 to which the electric wire 52*a* is attached. The terminal unit 57 is attached to the floor surface 300 side of the main body 56 in the direction Z.

The power supply line 52B has a plurality of electric wires 52*c* and a busbar 52*d* (conductor). The plurality of electric wires 52*c* are wires for connecting the electrode 18 and the busbar 52*d*. Therefore, one terminal of the electric wire 52*c* is connected to the electrode 18, and the other terminal of the electric wire 52*c* is connected to the busbar 52*d*. A large part of the electric wire 52*c* is routed on the floor surface 300. Apart of the electric wire 52*c* including the other terminal is disposed in the underground pit 400 through the opening 301 provided in the floor surface 300. The busbar 52*d* is a conductive structure that connects the power supply portion 55 and the electric wire 52*c*, and similar to the busbar 52*b*, the busbar 52*d* is accommodated in the underground pit 400. The busbar 52*d* is a conductor made of a metal such as copper or an alloy, and is a location where the heat can be generated most in the power supply line 52B. The busbar 52*d* is placed on a pedestal 401 fixed in, for example, the underground pit 400. The busbar 52*d* is disposed at a position that does not overlap the base stage 15 in the direction Z. The busbar 52*d* has a substantially L-shaped main body 58 and a terminal unit 59 to which the electric wire 52*c* is attached. The terminal unit 59 is attached to the floor surface 300 side of the main body 58 in the direction Z.

As shown in FIG. 4, an exhaust pipe 210 is attached to the gas supply mechanism 40 to which the power supply line 52A is connected, and an exhaust pipe 220 is attached to the gas supply mechanism 40 to which the power supply line 52B is connected. The exhaust pipe 210 is one of the configuration requirements of the exhaust mechanism 200A, and has a main portion 211 and a tip part 212. The exhaust pipe 220 is one of the configuration requirements of the exhaust mechanism 200B, and has a main portion 221 and a tip part 222. Each of the main portions 211 and 221 is routed on the floor surface 300. Each of the tip parts 212 and 222 is accommodated in the underground pit 400 through the opening 301. In the underground pit 400, the tip part 212 is disposed along the outer peripheral surface of the busbar 52*b*, and the tip part 222 is disposed along the outer peripheral surface of the busbar 52*d*. In the present embodiment, the tip part 212 is disposed along the both the portion that extends along the direction Z in the main body 56 of the busbar 52*b* and the portion that extends along the direction X in the main body 56. Similar to the tip part 212, the tip part 222 is disposed along both the portion that extends along the direction Z in the main body 58 of the busbar 52*d* and the portion that extends along the direction X in the main body 58. Although omitted in FIG. 3, the exhaust pipe 210 is branched from the gas supply line L1 and the exhaust pipe 220 is branched from the gas supply line L2.

The exhaust pipes 210 and 220 are made of a material that can withstand the high-pressure gas, and are, for example, metal or alloy pipes. In this case, the exhaust pipes 210 and 220 may exhibit conductivity. From the viewpoint of suppressing an increase in resistance of the power supply line 52A, the tip part 212 is separated from the busbar 52*b*. From the viewpoint of preventing contact between the tip part 212 and the busbar 52*b*, an insulating material or the like may be provided between the tip part 212 and the busbar 52*b*. Similarly, the tip part 222 is separated from the busbar 52*d*.

Figure 5A:
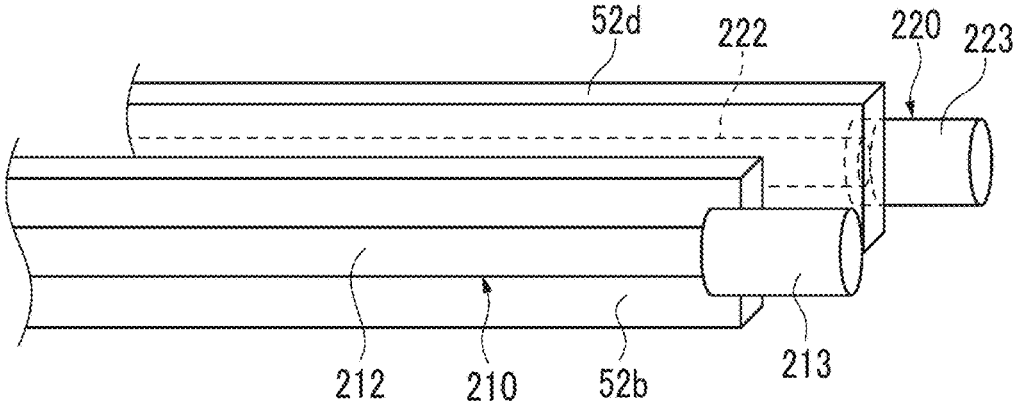
FIGS. 5A and 5B are schematic views showing a relationship between a busbar and a tip part.
Figure 5B:
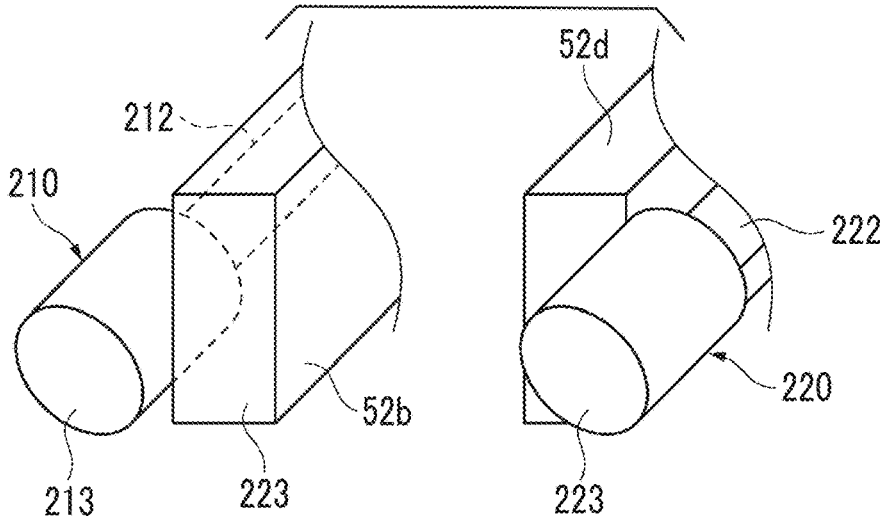
Figure 5C:
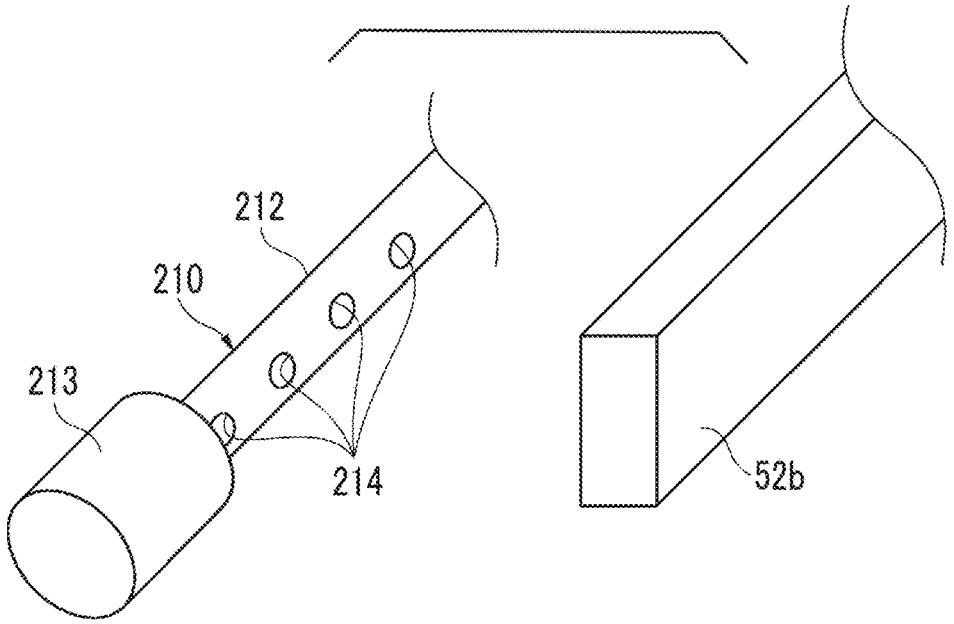
FIG. 5C is a view showing a state where the busbar and the tip part are separated from each other.

Here, with reference to FIG. 5A to 5C, the disposition of the busbars 52*b* and 52*d* in the underground pit 400 and the tip parts 212 and 222 will be described. FIGS. 5A and 5B are schematic views showing the relationship between the busbars 52*b* and 52*d* and the tip parts 212 and 222. FIG. 5C is a view showing a state where the busbar 52*b* and the tip part 212 are further separated from each other. In FIGS. 5A to 5C, safety valves 213 and 223 are attached to the tip parts 212 and 222, respectively. The safety valves 213 and 223 may be provided in the underground pit 400 or may be provided on the floor surface 300.

As described above, the tip part 212 is disposed along the busbar 52*b*, and the tip part 222 is disposed along the busbar 52*b*. In addition, the exhaust port 214 provided at the tip part 212 is provided so as to face the busbar 52*b*. Accordingly, the gas exhausted from the exhaust port 214 is blown to the busbar 52*b*. In the present embodiment, the tip part 212 is provided with a plurality of exhaust ports 214, but the present disclosure is not limited thereto. Although not illustrated, the exhaust port provided at the tip part 222 is provided so as to face the busbar 52*d*.

In the forming system 1, the controller 70 is incorporated in, for example, a fixed control panel, and is positioned on one side of the center of the forming apparatus 10 in the direction Y. Therefore, the controller 70 is positioned on the opposite side of the heating mechanism 50 with the forming apparatus 10 in the direction Y therebetween. In addition, the controller 70 is positioned on the opposite side of the tip parts 212 and 222 of the exhaust pipes 210 and 220 with the forming apparatus 10 in the direction Y therebetween. Accordingly, in a case where the worker uses the control panel, it is less likely to receive the influence of the heat generated from the heating mechanism 50 and gas exhausted from the exhaust mechanisms 200A and 200B. The controller 70 is positioned on the opposite side of the forming apparatus 10 with the transport mechanism 103 in the direction Y therebetween. Accordingly, in a case where the worker uses the control panel, the worker of the transport mechanism 103 is not hindered by the worker.

Effects

Next, the effects of the forming system 1 according to the present embodiment will be described. According to the forming system 1, the exhaust port 214 of the exhaust mechanism 200A is positioned in the internal space of the underground pit 400 which is a structure having an internal space. Therefore, the discharge noise generated when the high-pressure gas is exhausted from the exhaust port 214 is generated in the underground pit 400. In this case, the underground pit 400 functions as a silencer for the discharge noise. Therefore, the discharge noise is less likely to be noisy to a worker and the like who works around the forming apparatus 10. Therefore, by using the above-described forming system 1, it is possible to take countermeasures against the discharge noise. The structure that functions as a silencer is provided in the underground pit, which contributes to reducing the space of the entire forming apparatus.

According to the above-described forming system. 1, the tip part 212 of the exhaust pipe 210 included in the exhaust mechanism 200A and provided with the exhaust port 214 is positioned in the underground pit 400 provided at the lower portion of the floor surface 300. Accordingly, the discharge noise generated when the high-pressure gas is exhausted from the exhaust port 214 is generated in the underground pit 400. In addition, the tip part 222 of the exhaust pipe 220 included in the exhaust mechanism 200B and provided with the exhaust port is also positioned in the underground pit 400. Accordingly, the discharge noise generated when the high-pressure gas is exhausted from the exhaust port provided at the tip part 222 is generated in the underground pit 400. Therefore, the discharge noise is less likely to be noisy to the worker and the like who is on the floor surface 300 and works around the forming apparatus 10. Therefore, by using the forming system 1, it is possible to take countermeasures against the discharge noise.

In the forming system 1 of the present embodiment, the forming apparatus 10 includes electrodes 17 and 18 for heating the metal pipe material 14 and the power supply lines 52A and 52B connected to the electrodes 17 and 18, the power supply line 52A has the busbar 52*b* accommodated in the underground pit 400, and in the underground pit 400, the exhaust port 214 faces the busbar 52*b*. Therefore, the busbar 52*b* heated by energizing the electrode 17 can be cooled by the gas exhausted from the exhaust port 214. In addition, the power supply line 52B has the busbar 52*d* accommodated in the underground pit 400, and in the underground pit 400, the exhaust port provided at the tip part 222 faces the busbar 52*d*. Therefore, the busbar 52*d* heated by energizing the electrode 18 can also be cooled by the gas exhausted from the exhaust port.

Although the preferred embodiments of the present disclosure have been described above, the present disclosure is not limited to the above-described embodiment. For example, each power supply line may not have a busbar. The tip part is disposed along the outer peripheral surface of the busbar may be disposed along the inner peripheral surface of the busbar.

In the above-described embodiment, in the underground pit, the exhaust port of the exhaust pipe faces the busbar, but the present disclosure is not limited thereto. For example, in a case where the busbar is cooled by using a water-cooled cable or the like, the exhaust port of the exhaust pipe may not face the busbar. In other words, it is not necessary to cool the busbar with the gas exhausted from the exhaust port.

Figure 6:
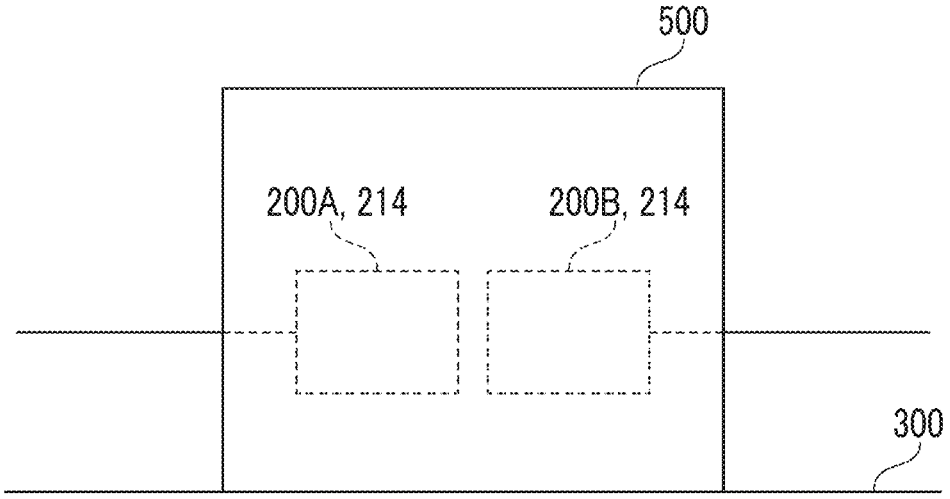
FIG. 6 is a conceptual view showing a structure around an exhaust mechanism of a forming system according to a modification example.

In the above-described embodiment, an underground pit under the floor is used as a structure that functions as a silencer. However, the structure is not particularly limited as long as an internal space in which the gas discharge unit can be disposed is provided and it is possible to block the sound generated in the internal space from leaking to the outside. For example, as shown in FIG. 6, the forming system may have a tank 500 as a structure. The exhaust port 214 of the exhaust mechanisms 200A and 200B are positioned in the internal space of the tank 500. When using the tank 500, the position of the tank 500 is not particularly limited. For example, the tank 500 may be disposed on the floor surface 300 instead of the underground pit.

For example, as a structure according to a comparative example, there is a structure in which a muffler is provided at the tip of the gas discharge unit to provide soundproofing. However, in a case where the exhaust pressure is high, there is a possibility that such a muffler cannot withstand the exhaust pressure, and is damaged. On the other hand, since the tank 500 has a sufficiently large internal space, there is a low possibility that the tank 500 is damaged even in a case where the exhaust pressure is high, and can be used for a long period of time. Such an effect can be similarly obtained in a case where the soundproofing is performed in the underground pit.

In the above-described embodiment, in addition to the forming apparatus, the forming system includes the first placing unit, the second placing unit, the transport mechanism, and the like, but the present disclosure is not limited thereto. For example, the forming system may not include at least one of the first placing unit, the second placing unit, and the transport mechanism. Further, the first placing unit, the second placing unit, the transport mechanism, and the like are not limited to the configurations shown in the above-described embodiment.

For example, the forming apparatus in the above-described embodiment does not necessarily have a heating mechanism, and the metal pipe material may have already been heated.

It should be understood that the invention is not limited to the above-described embodiment, but may be modified into various forms on the basis of the spirit of the invention. Additionally, the modifications are included in the scope of the invention.

What is claimed is:

1. A forming system for forming a metal pipe having a hollow shape, the system comprising:

a forming apparatus comprising:

a gas supply portion comprising a gas supply line connected to a gas source, wherein the gas supply portion is configured to supply gas into a heated metal pipe material when forming the metal pipe, a discharge unit comprising an exhaust pipe and configured to discharge the gas in the formed metal pipe, an electrode for heating the metal pipe material, and a power supply line connected to the electrode, a floor surface on which the forming apparatus is placed; and an underground pit provided at a lower portion of the floor surface, wherein an exhaust port of the discharge unit is positioned in an internal space of a structure including the internal space, the exhaust pipe is positioned in the underground pit as the structure and provided with the exhaust port, and the power supply line is accommodated in the underground pit together with the exhaust pipe.

2. The forming system according to claim 1, wherein the power supply line includes a conductor accommodated in the underground pit, and in the underground pit, the exhaust port faces the conductor.

3. The forming system according to claim 1, wherein the forming apparatus includes a forming die including an upper die and a lower die, a heating mechanism which energizes the metal pipe material to heat the metal pipe material, a pair of gas supply mechanisms for supplying the gas from the gas supply portion into the metal pipe material, and a water circulation mechanism which water-cools the forming die.

4. The forming system according to claim 2, wherein the upper die and the lower die of the forming die are formed of a steel block and an upper surface of the lower die and a lower surface of the upper die include a recessed portion, the upper die and the lower die include a cooling water passage inside, and include spaces at left and right ends of the upper die and the lower die, and the lower die includes a thermocouple inserted from below at a center.

5. The forming system according to claim 4, wherein the thermocouple is supported to be movable upward or downward by a spring, and in the spaces, electrodes are disposed to be capable of advancing and retreating upward and downward.

6. The forming system according to claim 3, wherein each of the pair of gas supply mechanisms includes a cylinder unit, a cylinder rod that advances and retreats in accordance with an operation of the cylinder unit, and a seal member connected to a tip of the cylinder rod.

7. The forming system according to claim 6, wherein at the seal member, a tapered surface is formed such that a tip is tapered, and the seal member is provided with a gas passage through which gas flows.

8. The forming system according to claim 6, wherein the gas supply portion further comprises the gas source, an accumulator in which gas supplied by the gas source is collected, a first tube which extends from the accumulator to the cylinder unit of the pair of gas supply mechanisms, a pressure control valve and a switching valve which are provided in the first tube, a second tube which extends from the accumulator to a gas passage formed in the seal member, and a pressure control valve and a check valve which are provided in the second tube.

9. The forming system according to claim 8, wherein the second tube is branched from the check valve into two, and includes gas supply lines that extend to the pair of gas supply mechanisms.

10. The forming system according to claim 3, wherein the water circulation mechanism includes a water tank which collects water, a water pump which pumps up the water collected in the water tank and sends the water to the lower die and the upper die, and a pipe.

11. The forming system according to claim 1, further comprising:

a first placing unit on which the metal pipe material is placed;

a second placing unit on which the formed metal pipe is placed; and a metal transporter configured to transport the metal pipe material or the metal pipe, wherein the first placing unit is positioned on one side of a center of the forming apparatus in a horizontal direction, and is positioned on one side of the center of the forming apparatus in a direction perpendicular to the horizontal direction, and the second placing unit is positioned on the other side of the center of the forming apparatus in the horizontal direction, and is positioned on one side of the center of the forming apparatus in the direction perpendicular to the horizontal direction.

12. The forming system according to claim 11, wherein the metal transporter is positioned between the first placing unit and the second placing unit and includes a main body and a robot arm.

13. The forming system according to claim 12, wherein the main body is further separated from the forming apparatus than the first placing unit and the second placing unit.

* * * * *